US009062951B2

(12) United States Patent
Alkhalaileh et al.

(10) Patent No.: US 9,062,951 B2
(45) Date of Patent: Jun. 23, 2015

(54) SHOTGUN SHELL OR LOW VELOCITY GRENADE DISPENSER AND RELOADER SYSTEM

(71) Applicants: Samer Alkhalaileh, Dublin, OH (US); John Richard Warnke, Westerville, OH (US); Robert Irvin, Hilliard, OH (US); Joshua Keith Cox, Marysville, OH (US)

(72) Inventors: Samer Alkhalaileh, Dublin, OH (US); John Richard Warnke, Westerville, OH (US); Robert Irvin, Hilliard, OH (US); Joshua Keith Cox, Marysville, OH (US)

( * ) Notice: Subject to any disclaimer, the term of this patent is extended or adjusted under 35 U.S.C. 154(b) by 98 days.

(21) Appl. No.: 13/860,115

(22) Filed: Apr. 10, 2013

(65) Prior Publication Data

US 2014/0317986 A1 Oct. 30, 2014

Related U.S. Application Data

(60) Provisional application No. 61/622,169, filed on Apr. 10, 2012, provisional application No. 61/652,487, filed on May 29, 2012, provisional application No. 61/724,524, filed on Nov. 9, 2012, provisional application No. 61/730,223, filed on Nov. 27, 2012.

(51) Int. Cl.

| | |
|---|---|
| ***F41A 9/85*** | (2006.01) |
| ***F42B 39/00*** | (2006.01) |
| ***F41A 9/70*** | (2006.01) |
| ***F41A 9/65*** | (2006.01) |

(52) U.S. Cl.
CPC ..... *F42B 39/002* (2013.01); *F41A 9/70* (2013.01); *F41A 9/65* (2013.01)

(58) Field of Classification Search
CPC ..... F41A 9/65; F41A 9/66; F41A 9/67; F41A 6/70
USPC ..... 89/34, 33.4; 42/87, 88, 50
See application file for complete search history.

(56) References Cited

U.S. PATENT DOCUMENTS

| | | | | |
|---|---|---|---|---|
| 1,015,516 | A * | 1/1912 | Sjogren | 42/18 |
| 7,168,200 | B2 * | 1/2007 | Perez et al. | 42/98 |
| 2010/0154269 | A1 * | 6/2010 | Escalante, III | 42/49.01 |

FOREIGN PATENT DOCUMENTS

| | | | |
|---|---|---|---|
| FR | 974688 | * | 2/1951 |

* cited by examiner

*Primary Examiner* — Stephen M Johnson
(74) *Attorney, Agent, or Firm* — Brannon Sowers & Cracraft; C. John Brannon

(57) ABSTRACT

A shotgun shell or low velocity grenade dispenser and reloader system that can quickly and efficiently dispense a shell without requiring the focus of the operator. The dispenser can be attached to the operator's belt, leg, forearm, or a weapon. Alternatively the dispenser may be left unattached. The dispenser delivers a shell in an orientation that allows rapid loading of a weapon with minimal shell manipulation.

20 Claims, 11 Drawing Sheets

SHOTGUN SHELL OR LOW VELOCITY GRENADE DISPENSER AND RELOADER SYSTEM

CROSS-REFERENCE TO RELATED APPLICATIONS

This application claims priority to U.S. provisional patent application Ser. No. 61/622,169, filed Apr. 10, 2012; U.S. provisional patent application Ser. No. 61/652,487, filed May 29, 2012; U.S. provisional patent application Ser. No. 61/724,524, filed Nov. 9, 2012; and U.S. provisional patent application Ser. No. 61/730,223, filed Nov. 27, 2012, each of which are incorporated herein in their entirety by reference.

BACKGROUND

Shotgun shell carriers and dispensers provide the operator of a shotgun several rounds, usually located in a local container, to reload the gun. Some shell dispensers are positioned on the gun; others are carried on a belt worn by the operator. Many current shell dispensers require the operator to visually locate a shell by looking away from the target and towards the dispenser. Then, the operator removes his/her non-trigger hand from the shotgun, and using visual cueing, reaches for and grasps the shell with his/her fingers to effect its' removal from the dispenser. Then, the shell is manually oriented (rotated, flipped), usually with visual cueing, within the hand to align it with the open breach of the shotgun. A shell is then placed into the breach; this step can usually be done, with practice, without visual cues. At this point, both hands are returned to the shotgun, the target visually re-captured, aim re-established and finally, the trigger squeezed. The process is repeated until the target is sufficiently damaged and, in combat situations, until the danger is averted.

This reloading process takes time as well as a modicum of visual and manual dexterity. Thus, it requires good visibility to find the shells within the carrier/dispenser and also to orient them. Reloading further requires finger motion to manipulate the shell. The reloading task can be frustrated by obstacles, such as loose or bulky clothing, heavy gloves, low temperature leading to poor manual dexterity, anxiety, poor vision, darkness, heavy rain, fog, glasses, visor, helmet, night-vision goggles, heavy perspiration, rapid breathing, and the like. None of this is conducive to rapid and accurate shooting, especially when necessary to quell target danger.

Shotguns, at times of extreme operator duress, must perform efficiently, frequently in very non-ideal situations, like darkness, heavy rain, smoke, bright lighting, frequent close explosions of noise, and the like, in order to protect the operator. For example, the operator may be wearing bulky clothing (such as advanced armor) that could impede access to the shotgun shell in its carrier or a helmet, visor, sunglasses, and/or ear-protection, which could insulate him/her from tactile sensory feedback.

One common feature of prior art shell carrier and dispenser designs is the requirement to obligate one free hand for pulling a shell from its carrier, manipulating the shell, and loading the shell into the gun. These dispensers require operator visual cues and attention to find and retrieve the shell. This is very difficult to perform in the dark, while wearing body armor, visor and/or a helmet. These dispensers require fidelity, attention, and hand-to-eye coordination to manipulate the shell. In high-stress situations, such as a police SWAT mission, wartime, or terrorism incidents, attention, coordination, dexterity, and sensory feedback may be sorely lacking.

Retrieving a shell from the above described shell carriers/dispensers requires seconds and will almost certainly present a distraction to the gun operator. In one style of the shotgun shell carrier, where the carrier is attached to the gun, retrieving a shell requires the gun position to be changed to access the shells. This requires the operator to re-target and re-aim the shotgun, a process that takes valuable time in critical moments under threat.

It is a common space-saving requirement of current dispensers that the shells be loaded alternating base (brass) up and base down. This requires the gun operator to identify the orientation and manipulate the shell to facilitate loading the gun. A quick single shell load into the ejection port requires the shell be in a certain orientation in the shell carrier/dispenser. After a quick shell load through the ejection port, loading the rest of shells through the magazine loading port into the gun magazine follows. Loading rounds into the magazine requires a different shell orientation than loading a shell through the ejection port in the operator hand, which also means a different shell orientation in the shell carrier is required, unless the operator would turn the shell in his/her hand to get the proper orientation. All this requires time, coordination, attention, all of which may be scarce in an imminent threat situation.

For law enforcement and military activities, reloading a shotgun quickly, with little or no gun positional re-orientation, target re-acquisition and little time or effort spent retrieving and handling shells is critical, especially under stressful conditions. Thus there is a need for a shell dispenser that does not require the gun operator to look away from the target during reloading. The present novel technology addresses this need.

DETAILED DESCRIPTION

Figure 1:
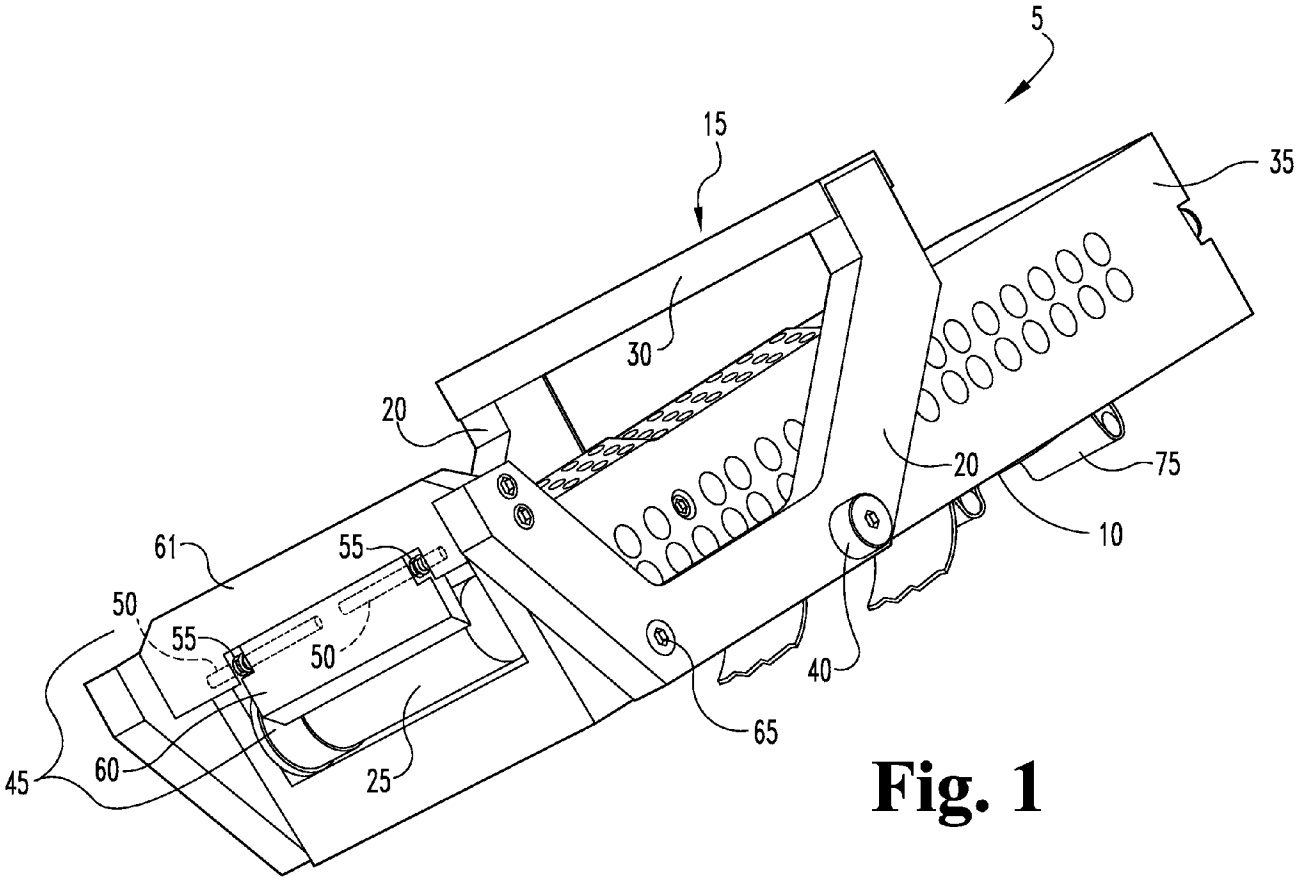
FIG. 1 is a perspective view of a shell dispenser assembly according to one embodiment of the disclosed invention.

For the purposes of promoting an understanding of the principles of the novel technology, reference will now be made to the embodiments illustrated in the drawings and specific language will be used to describe the same. It will nevertheless be understood that no limitation of the scope of the novel technology is thereby intended, such alterations and further modifications in the illustrated device, and such further applications of the principles of the novel technology as illustrated therein being contemplated as would normally occur to one skilled in the art to which the novel technology relates.

Figure 2:
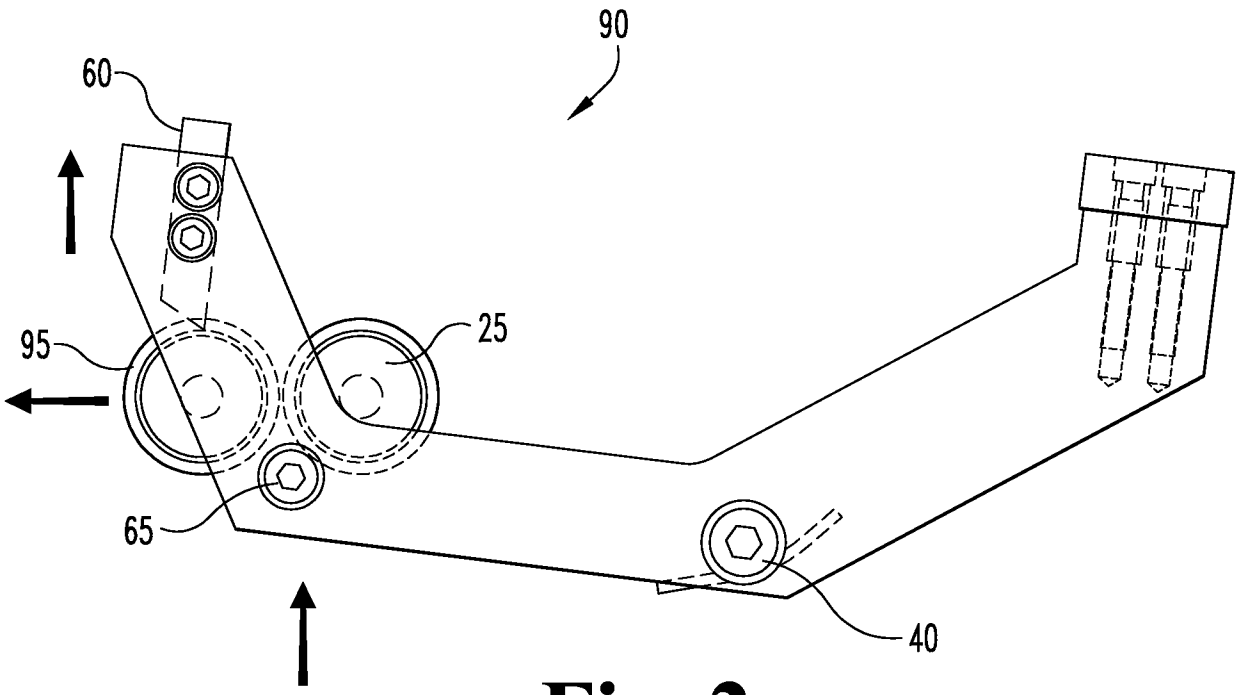
FIG. 2 is a detailed side view of an ejector mechanism used in the embodiment show in FIG. 1.
Figure 3:
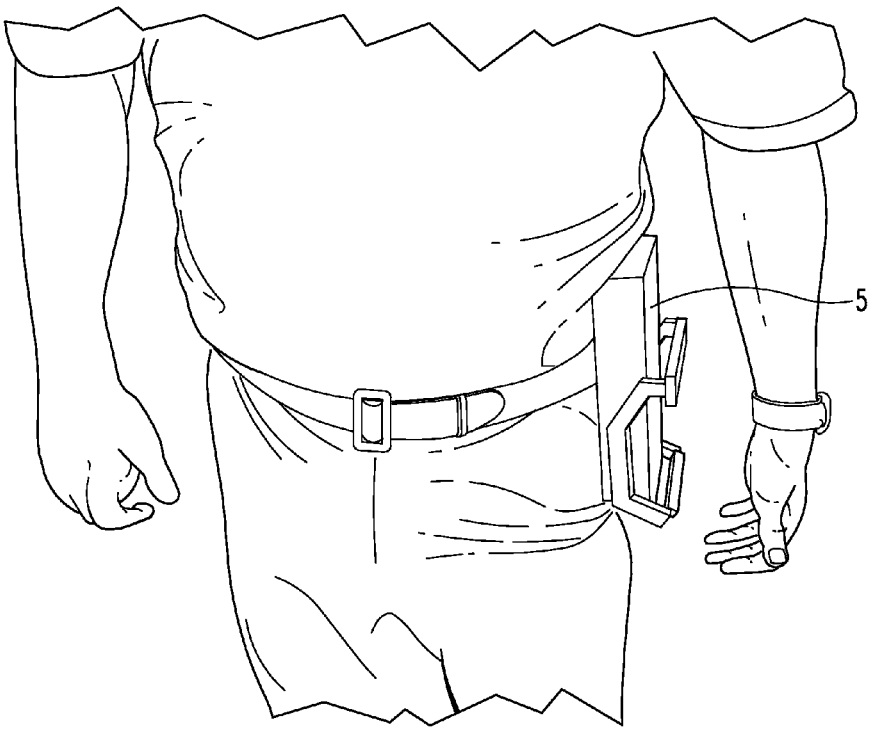
FIG. 3 is a is a perspective view of a shell dispenser assembly according to another embodiment of the disclosed invention mounted to a utility belt worn by a user.

One embodiment of the present novel technology, as shown in FIGS. 1-3, is a shotgun shell dispensing assembly 5 that holds a plurality of shells 25 and allows delivery of shells 25, one at a time, to the fingers and hand of the operator without the need to manually pull shells out of a carrier or container. A shell 25 is ejected into the operator's hand once the trigger bar 15 of the shell dispenser assembly 5 is pushed down with the forearm of the operator. No further effort is needed to move a single shell 25 into the operator's hand. The shell 25 is delivered to the operator's hand in the proper orientation required to quickly load into the shotgun, whether the operator is performing a quick ejection shell load, or a conventional multi shell load through the magazine loading port. No further effort is needed from the operator to reorient or position the shell in the hand to load it into the shotgun. This assembly 5 can be sized to fit several different shells 25, including, but not limited to, shotgun shells 25 with ten-gauge, twelve-gauge, twenty-gauge or 410-bore shotgun shells, as well as low velocity grenade sizes such as thirty-seven-mm and forty-mm diameter shells along with any other sizes the grenades may come in.

The novel shotgun shell dispenser assembly 5 of this invention can be made of plastic, metal, or any convenient material that can be formed, machined, molded or stamped into the shape of the shell dispenser components. The assembly 5 is rigid enough to perform the shell dispenser function: carry the shells 25 and support loading and shell 25 ejection functions. The assembly 5 is light enough to be portable and wearable by the operator. The assembly 5 is small enough to attach to the utility belt, the forearm of the operator, or even attach directly to the arm of the gun operator. The assembly 5 operates without any external power, other than a compressed spring and limb motion of the operator. The shell ejection mechanism 90 can be used for several sizes of shotgun shells 25 as well as shells of low velocity grenades. In addition to easy delivery of shells to the operator, the shell dispenser can be loaded with fresh shells while attached to the utility belt on the waist or while separate from utility belt. The dispenser can be easily removed and a fresh loaded dispenser mounted.

The shotgun shell loading assembly 5 is comprised of three main components: the shell enclosure 10, the shell ejection mechanism 90, and the shell dispenser gate 45.

The shell enclosure 10 is typically rectangular-shaped five-sided enclosure. The shell ejection mechanism 90 is comprised of two side bars 20 that support the rest of the mechanism 90 components, a trigger bar 15 enclosed in a soft rubber cover 30, one or more springs 55 that keep the ejection mechanism 90 in a biased position (normally closed) that will maintain shells 25 inside the shell housing 35, a shell blocking rod or pin 65 which stops the advancement of shells 25 when in the closed position, one or more pivot points 70 on either side of the dispenser 5 that allow the ejection mechanism 90 to rock, and the dispenser gate 45, which keeps the round 25 from exiting out of the dispenser 5 while the ejection mechanism 90 is closed. Additionally, the assembly 5 includes a safety-locking pin 40 that may be pressed to lock the ejection mechanism 90 when the assembly 5 is not in use.

In one example, the walls of the enclosure 10 are made out of a solid material that is rigid enough to carry the weight of the shells 25 and bear the pressure of the shell ejector mechanism 90. It will also support the dispenser gate 45 and the pressure of the shells 25 being pushed by the spring 85 behind the follower 80. The size of the enclosure 10 can be sized to ensure compatibility with shells 25 of various shotgun gauges, including, but not limited to ten, twelve, twenty-gauge, and 410 gauge shotgun shells, as well as shells of low velocity grenades, including but not limited to shells with a diameter of thirty-seven mm, forty mm, or any other sizes low velocity grenades may come in.

The shell dispenser gate 45 is made up of a gate holder 61 and the unidirectional moving gate 60 that sits below the gate holder 61. The gate holder 61 is connected to the side bars by pins 50 on each side that insert through the gate holder 61 and connect the unidirectional moving gate 60 to the gate holder 61. Wrapped around the pins 50 are springs 55. These springs 55 keep the unidirectional moving gate 60 in the default-closed position to maintain shells 25 inside the enclosure 10. The lower part of the dispenser gate 45 is the unidirectional moving gate 60 that rotates in only inwards, toward the shell enclosure 10 to allow shells 25 to be loaded and maintained in the shell enclosure 10.

The shell spring 85 and follower maintain pressure on the shells 25 inside the enclosure 10. This force allows shells 25 to advance each time the trigger bar 15 is depressed, hence, ejecting a shell 25 out of the enclosure 10. Gravity causes the ejected shell 25 to drop and/or roll into the operator's hand. For further convenience, the assembly 5 may include belt clips 75 so the operator may directly attach the assembly 5 to his/her belt.

The first step in operating the assembly 5 is loading shells 25 into the enclosure 10 by inserting the shells 25 through the unidirectional moving gate 60 into the enclosure 10. The operator will hold a shell 25 in the preferred orientation (i.e., with the brass oriented in the desired direction) and push it onto and past the lower part of the gate, the unidirectional moving gate 60. The unidirectional moving gate 60 will deflect, moving inwards, and allow a shell 25 to be loaded into the enclosure 10. The loaded shell 25 will push the shell follower and spring (not shown) backwards into the body of the enclosure 10. This action can be repeated until there is no free space inside the enclosure 10. This action may be performed with the assembly 5 worn on the belt of the waist or held separately.

Shell 25 ejection is performed after the assembly 5 has been loaded and can continue until the last shell 25 is ejected. In one embodiment, one shell 25 is ejected each time the trigger bar is activated. In other embodiments, a greater number of shells may be ejected for each activation of the trigger bar. The shell blocking rod 65 prevents ejection of multiple shells at the same time. Each time the trigger bar 15 of the ejection mechanism 90 is depressed, the ejection mechanism 90 will allow one round 95 only to leave the enclosure while keeping the rest of the shells 25 inside the enclosure until the next shell in needed. The assembly is designed to keep shells 25 from jamming the mechanism 90. Also, the open design, allows for visual inspection of shells as well as cleaning while still inside the enclosure 10, keeping dirt from clogging the enclosure. During shell 25 ejection, the operator arm should be extended straight down and the forearm should be close to the trigger bar, the hand should be positioned directly below the dispenser in order to receive the dispensed shell.

In order to operate the dispenser, the operator typically extends his/her arm downwards; then contact is made between the forearm of the extended arm and the trigger bar on the dispenser, this action releases one shell 25 and drops it into the hand of the arm that just made contact with the trigger bar, the exchange between forearm and trigger bar is a gross motor skill, finger dexterity is not required, visual cues are not necessary either. Depression of the lever and shell ejection generally occurs when the operator pushes against the trigger bar with affirmative arm motion. The hands remain free, saving time and effort to place a shell in the hand and load the gun.

Generally, this assembly 5 allows shell ejection, capture, and gun loading to be possible in extreme cold, extreme noise, heavy rain, with eyes-closed or blinded by fog, snow, dark, or flashes of bright light, with thick gloves, bulky body armor, loose torn clothing, intense distraction or other adverse personal or environmental conditions.

The following examples are merely representative of the work that contributes to the teaching of the present novel article and is not to be restricted by the following examples.

Example 1

Figure 4:
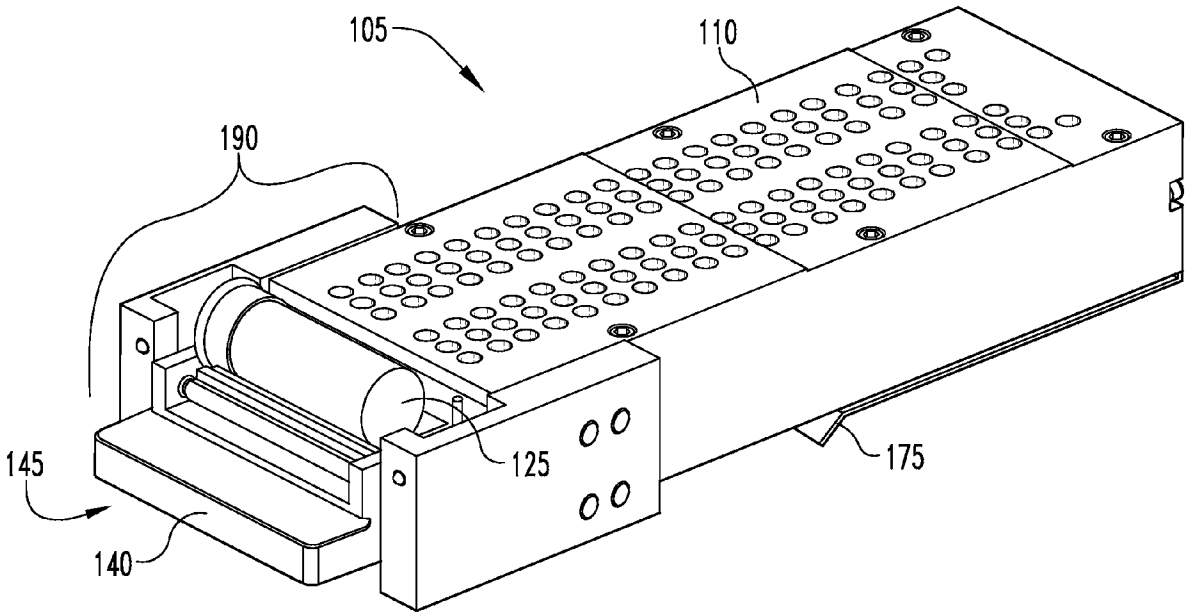
FIG. 4 is a perspective view of a shell dispenser assembly according to another embodiment of the disclosed invention.

The dispenser assembly 105 illustrated in FIG. 4, is a variant of the above described assembly with an alternate ejection mechanism 190. Instead of utilizing the ejection mechanism 90 described above, this assembly utilizes a shell carrier 140 (FIG. 13) that rotates around a fixed axis when the operator pushes down the dispenser lever 145 that is operationally connected and maneuvers the shell carrier 140. The shell carrier 140 rotation moves one single shell 125 out of the shell enclosure 110, while at the same time blocking the rest of the shells 125 inside the enclosure 110. Once the operator stops applying pressure against the dispenser lever 145, the shell carrier 140 returns to the closed position due to tension in two springs 155 located at the sides of the shell carrier 140.

Example 2

Figure 5:
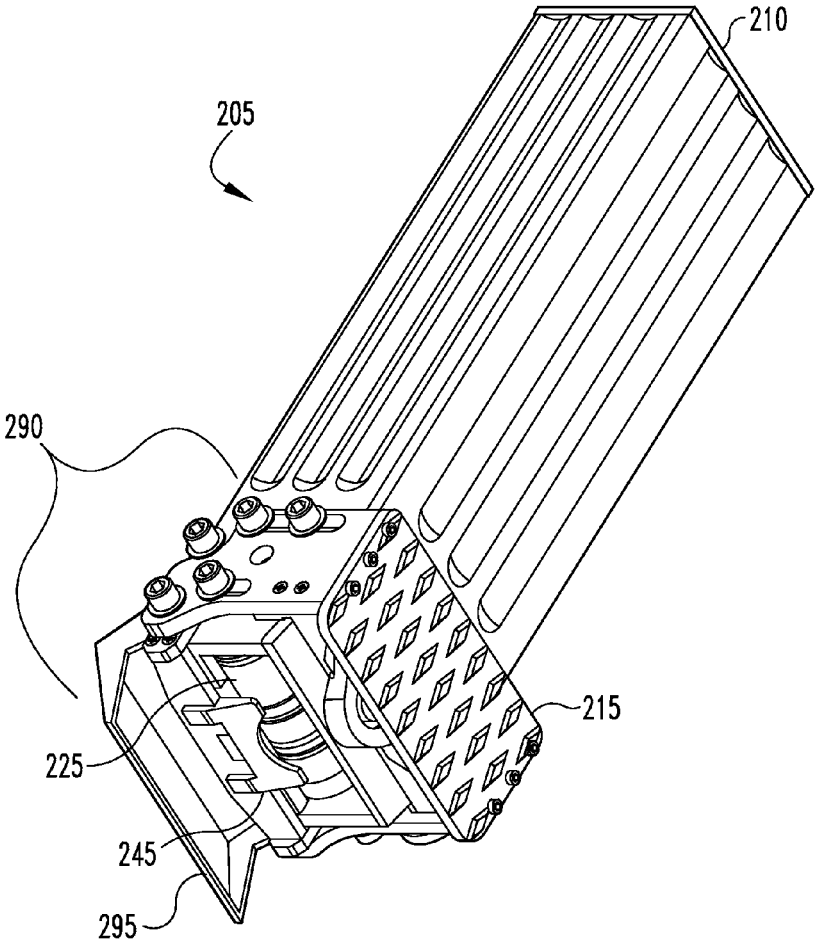
FIG. 5 is a perspective view of a shell dispenser assembly according to still another embodiment of the disclosed invention.

The dispenser assembly 205 illustrated in FIG. 5, is another variant of the novel technology. In this particular example, dispenser assembly 205 will be holding and dispensing 37 or 40 mm low velocity grenades 225. The assembly 205 is also equipped with an alternate ejection mechanism 290. The assembly 205 utilizes an ejection mechanism 290 that can be operated by pushing against an activation plate 215. The activation plate 215 is connected to the rest of the assembly 205 and upon depressing activation plate 215 the dispenser gate 245 will open, thereby releasing a grenade shell 225 being held in the dispensing position. Springs bias dispenser gate 245 in a closed position, blocking the shells 225 and keeping them from exiting the shell enclosure 210. Once the gate 245 is opened, a shell 225 will exit the enclosure 210 and drop into the open hand of the operator. When the exiting shell 225 is ejected, the shell 225 next in queue behind the exiting shell 225 is blocked by a shell blocking rod that is operationally connected to the activation plate 215. The shell blocking rod depresses with the activation plate 215, thus positioning the shell blocking rod in front and blocking the shell 225 next in queue. Once pressure is removed from the activation plate 215 the shell blocking rod retracts and allows the next shell 225 to drop down in the dispensing position 235.

Loading shells into the dispenser is done similar to the first two assemblies, by pushing the shells 225 into the enclosure 210 through the same opening the shell 225 is ejected from. Every time a shell 225 is pushed into the enclosure 210 it will collapse the gate 245 as it enters the enclosure. The loaded shell 225 will also push the shell follower and spring (not shown) into the body of the enclosure 210. This action can be repeated until there is no free space inside the enclosure 210.

A small basket 295 may be added below the dispenser gate 245. If the operator does not catch an exiting shell, the basket will safely catch the shell so that there is no risk of a shell falling and hitting a solid object and accidently detonating.

Example 3

Figure 6:
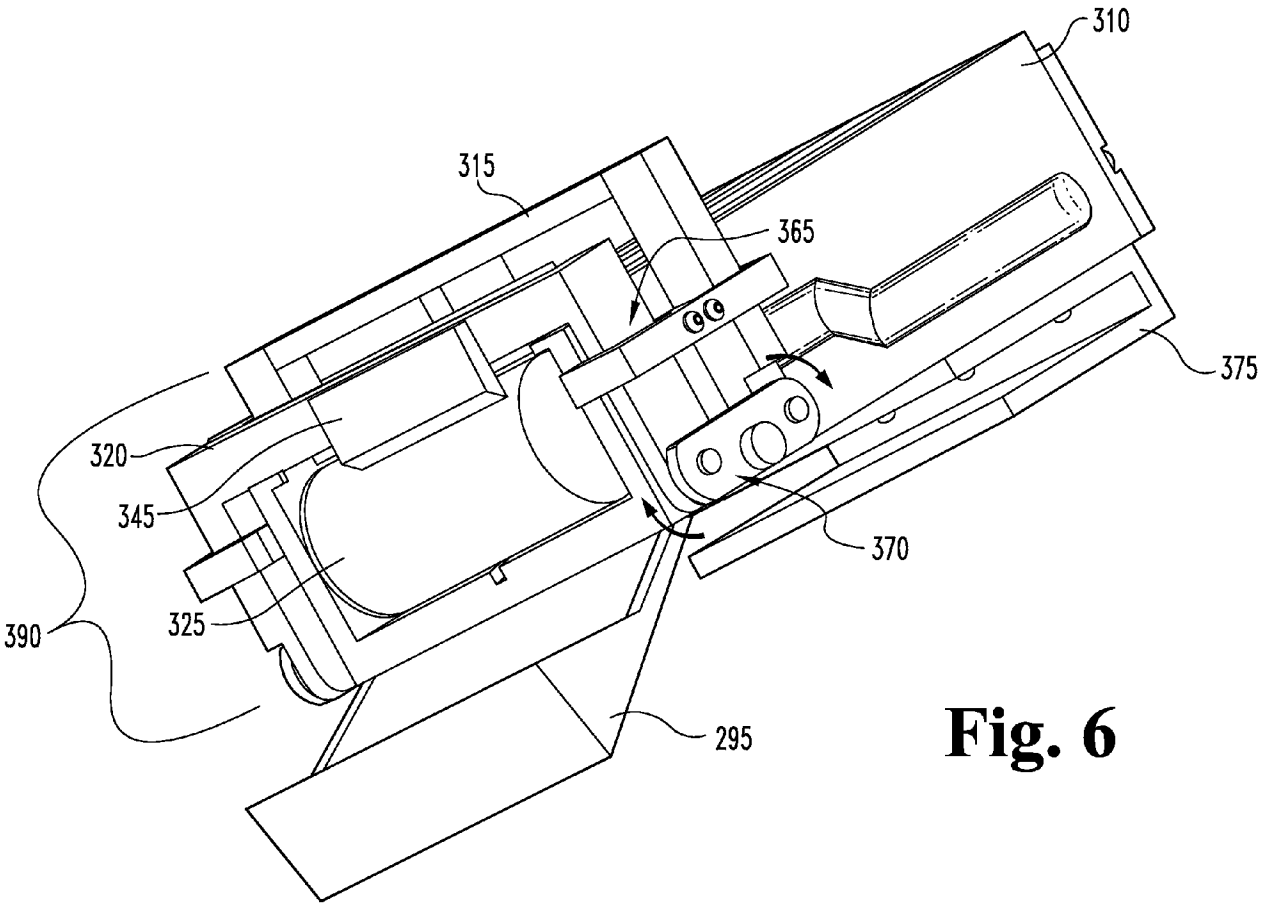
FIG. 6 is a perspective view of a shell dispenser according to yet another embodiment of the disclosed invention.

The dispenser assembly illustrated in FIG. 6 is yet another variant of the novel technology. In this example assembly is configured for holding and dispensing grenade shells 325. This particular assembly is equipped with an alternate ejection mechanism 390. The third example utilizes a dispenser mechanism that can be operated against an activation plate 315, which is operationally connected to the rest of the release mechanism 390 and upon depressing will push down on a pivot screw 370, which manually pushes the gate holding bar 320 up. Since a unidirectional gate 345 is connected to the gate holding bar 320, the gate 345 temporarily lifts and opens with the depression of the activation plate 315 allowing a shell 325 to free fall into the hand of the operator. Similar to the previous example, absent of pressure on the activation plate 315, the gate 345 is normally in a closed position to keep shells from exiting. Springs 355 located behind the pivots 370 bias gate 345 in the closed position. The shell next in queue behind the exiting shell is blocked by the shell blocking plate 365 that is connected to the activation plate 315 and descends with a push on the activation plate 315 to block the next shell 325 while the shell in the dispensing position 335 is ejected form the enclosure 310. Once pressure is removed from the activation plate 315 the shell blocking plate 365 retracts and allows the next shell 325 to drop down into the dispensing position 335.

Loading shells 325 into the dispenser is done similar to the previous examples by pushing the shell 325 into the enclosure 310 through the opening past the unidirectional gate 345. Each time a shell is pushed into the enclosure 310 it will collapse the unidirectional gate 345 as it enters the dispenser cavity and will also push the shell 325 ahead of it upwards. Shells 325 may continue to be loaded into the enclosure 310 until there is no longer space left to accommodate more shells 325.

In Example 3 a mounting bracket 375 may be added to the back of the assembly, this bracket 375 will be used to attach the assembly to gun turret (for example) in a military vehicle.

Example 4

Figure 7:
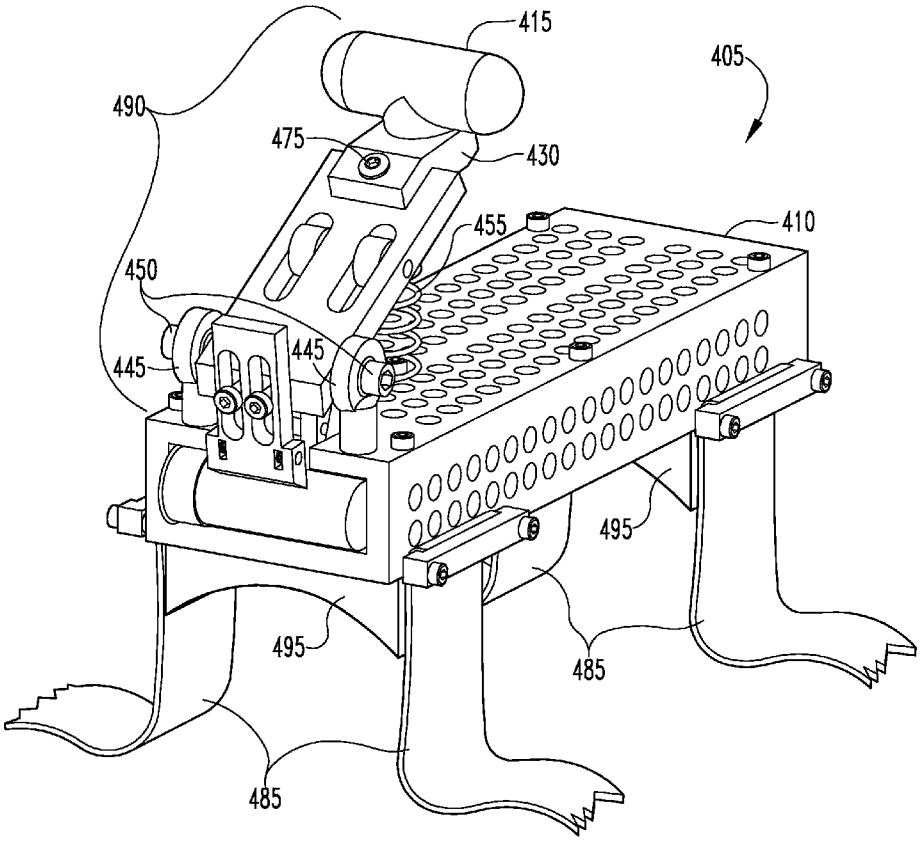
FIG. 7 is a perspective view of a shell dispenser according to still another embodiment disclosed invention.
Figure 8:
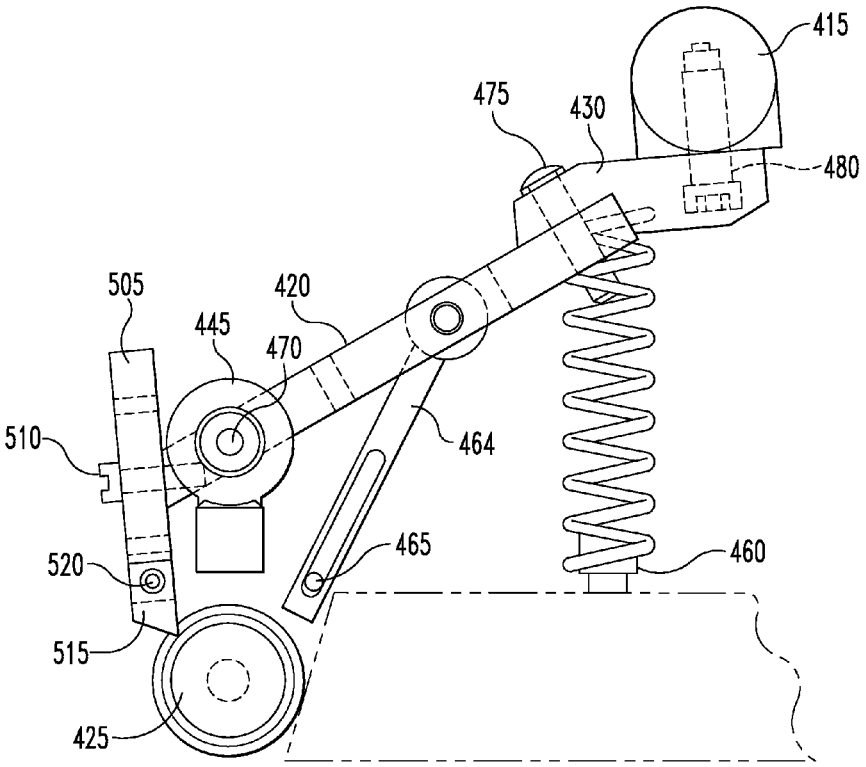
FIG. 8 is a detailed drawing of a shell ejection mechanism according to one embodiment of the disclosed invention.

The dispenser assembly 405 illustrated in FIGS. 7-8 is another variant of the novel technology with another alternate ejection mechanism. Here, the alternate shell ejection mechanism 490, comprising an ejection plate 420 operationally connected to a lever 430. On top of the lever 430 is a knob 415 or handle designed and configured to be operated by hand. The knob 415 is operationally connected to the lever 430 by a screw 480 that extends from the knob 415 through the lever 430, although other securing means are possible. The lever 430 is then connected to the shell ejection plate 420 by a screw 475, although other securing means are also possible. The shell ejection plate 420 supports an ejection pin 464. Ejection pin 464 motion is guided by an ejection alignment pin 465, which is secured in the enclosure 410. The shell ejection mechanism is kept in a biased position by a spring 455 that allows the ejection mechanism 490 to temporarily maintain the shells 425 inside the enclosure 410. A position maintaining spring 455 positioned below the knob 410 rests on top of the enclosure box 410. It is secured in place by a cap screw 460 into the top surface of the enclosure 410. The shell ejection plate 420 can rock on an axis 470 that is created by two socket cap-screws 450 that bolt into the shell ejector plate 420 through two bearing posts 445 that sit atop the front end of the enclosure 410.

The dispenser gate 505 is connected to the ejection plate 420 by dispensing gate screws 510 that attach through the dispenser gate 505 into the front tip of the ejection plate 420. Attached to the bottom of the dispenser plate is a unidirectional gate 515. The unidirectional gate 515 is attached to the dispenser gate by unidirectional gate screws 520. Similar to previous examples, the unidirectional gate 515 is operationally attached to the ejection mechanism 490 to stop the ejection of shells 425. The gate's 515 ability to move in an inward direction allows shells 425 to be loaded into the enclosure 410. Loading shells into the dispenser is done similar to the previous examples by pushing the shell 425 into the enclosure 410 through the opening past the unidirectional gate 515. Every time a shell is pushed into the enclosure 410 it will collapse the unidirectional gate 515 as it enters the enclosure 410 and the shell will also push the shell 425 ahead of it upward. Shells 425 may continue to be loaded into the enclosure 410 until there is no longer space left to accommodate more shells 425.

After the shells are manually loaded into the enclosure 410, the assembly 405 may be secured on the forearm of the operator using a strap 485 that wraps around the arm of the operator. The assembly may also include rubber pads 495 for comfort. Alternatively, the assembly can be attached anywhere on the body where comfortable and accessible such as the hip, leg, or chest.

To dispense a shell 425, the operator presses down on the knob 415, which triggers the ejection mechanism 490. Placing pressure on the knob 415 pushes down on the shell ejection plate 420. The shell ejection plate 420 rocks on the plate rocking axis 470 and lifts the entire shell ejection mechanism 490, including the shell dispenser gate 515, allowing the shell 425 that was blocked by the dispenser gate 515 to be ejected. At the same time, placing pressure on the knob 415 presses the ejection pin 464 deeper into the enclosure to block the next shell from exiting while the dispenser gate is open.

Example 5

Figure 9:
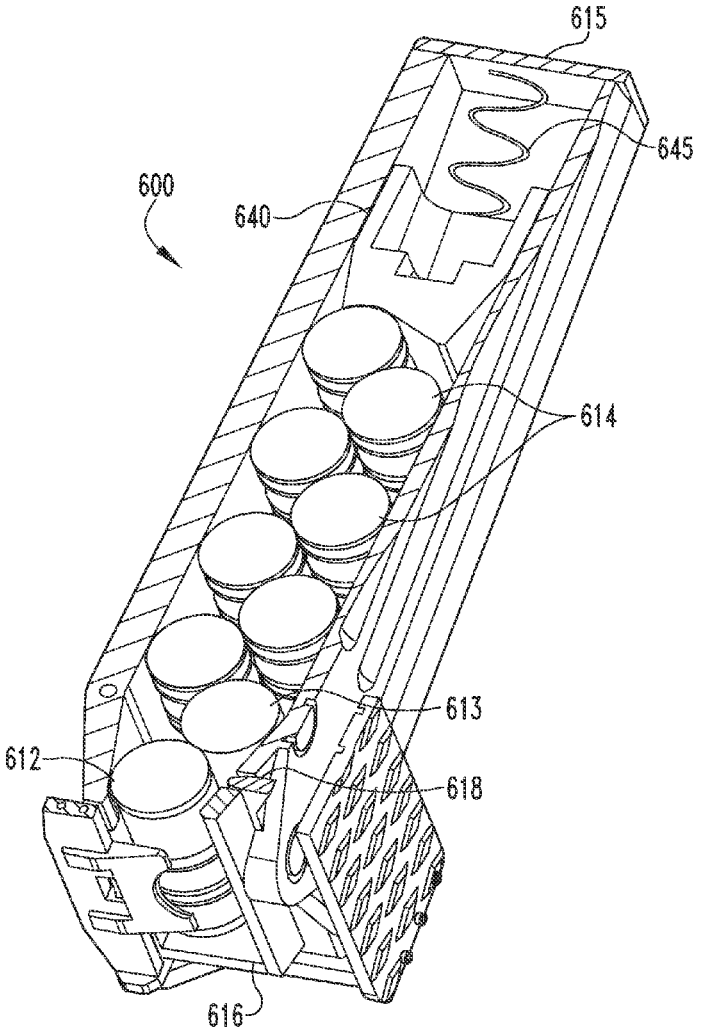
FIG. 9 is a partial cut away perspective view of another embodiment of the disclosed invention.
Figure 10:
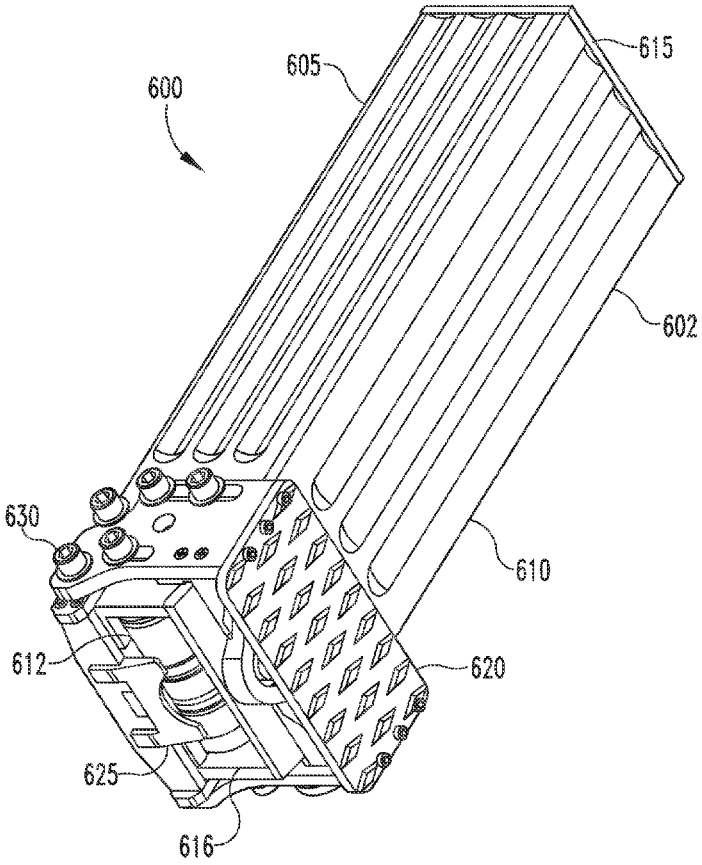
FIG. 10 is a perspective view of another embodiment of the disclosed invention.
Figure 11:
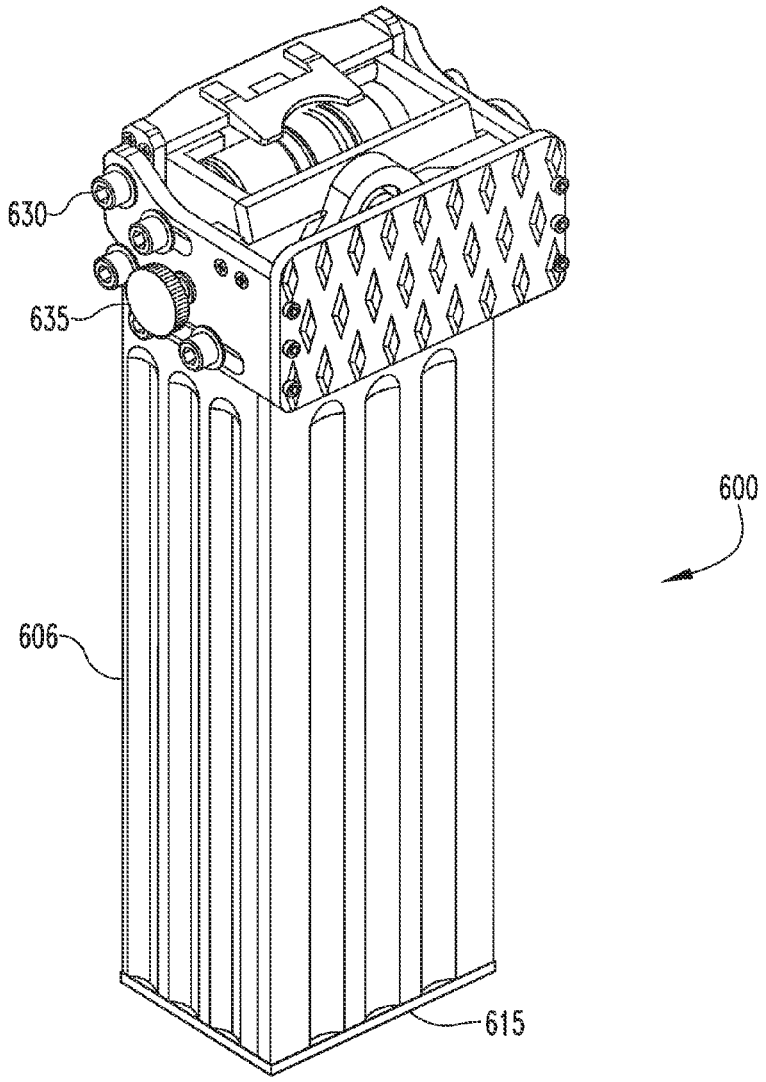
FIG. 11 is a perspective view of yet another embodiment of the disclosed invention.

A still further embodiment of an ammunition storage and dispensing device 600 according to the novel technology is disclosed in FIGS. 9-11. In this particular example, the ammunition storage and dispensing device 600 comprises a generally rectangular housing 602 sized and configured to hold a particular type of ammunition and having a front wall 610 and an oppositely disposed rear wall (not shown), a first side wall 605 and an oppositely disposed second side wall 606, a top wall 615, and an open bottom 616. In this particular example, the top, first side, second side, front, and rear walls are all shown as solid. In other examples, these walls may be partially open such as by a plurality of holes, openings, slots, and the like as disclosed in other examples previously discussed herein.

Dispensing device 600 further includes a follower device 640 disposed within housing 610. Disposed between housing top wall 615 and follower device 640 is a spring 645. Spring 645 is sized and configured to apply sufficient force to follower 640 so as to urge the follower away from the top wall and move ammunition 614 disposed within housing 610 away from top wall 615 and towards opening 616. Although spring 645 is shown as a helical coil spring in this particular example, other varieties of spring such as leaf spring may also be used.

Dispensing device 600 further comprises a dispenser gate 625 positioned across open end 616. Dispenser gate 625 is movable between an open position which allows ammunition to be removed from housing 610 through opening 616, and a closed position which prevents the removal of ammunition. In FIGS. 9-11, dispenser gate 625 is shown in the closed position so as to block the exit of the round of ammunition 612 nearest opening 616. In this particular example, ammunition 612, 613, and 614 is shown as low velocity grenades. This is for illustrative purposes only and in other examples shotgun shells may also be stored and dispensed in a similar device. Also for purposes of this example the ammunition is shown as being disposed within housing 610 in a staggered arrangement. As previously discussed in other examples, the ammunition may be disposed in a linear or stacked arrangement.

An ejector plate 620 is operationally connected to dispenser gate 625 by a pin 630 and is configured to selectively move dispenser gate 625 between the open and closed positions as desired by the user. Ejector plate 620 is shown as a generally rectangular plate, but on other configurations the plate may be larger or smaller or have a different shape as desired. In still other examples, the plate may be replaced by a lever or handle which is operably connected to the dispenser gate such as in the previous examples.

One or more springs (not shown) are disposed in dispensing device 600 so as to bias dispenser gate 625 into the closed position. These springs act to keep the dispensing gate closed unless the ejector plate or lever is activated by the user. These biasing springs may be operably connected to the dispenser gate directly, to the ejector plate, or a combination of both the dispenser gate and the ejector plate as desired. One of ordinary skill in the art will see that such biasing spring(s) could be placed in a variety of locations on the device 600 so long as the spring(s) biased the dispenser gate 625 into the closed position either directly or indirectly. For example, a biasing spring which acted to bias the ejector plate into the closed position would also (indirectly) bias the dispenser plate into the closed position through the ejector plate.

Dispenser 600 further includes a blocking pin 618 operationally connected to the ejector plate 620. In other examples, the blocking pin may be operationally connected to the dispenser gate. In this particular example, when the ejector plate 620 is moved by the user into the open position, the blocking pin 618 moves into housing 602 so as to obstruct the movement of the second round of ammunition 613 nearest the opening 616, thereby preventing the ejection of more than one round of ammunition when the ejector plate is activated. The exact size, shape, and configuration of the blocking pin 618 can vary so long as it is capable of preventing ammunition from moving towards the opening 616. In other embodiments, the blocking pin is operably connected to the dispenser gate so as to prevent the ejection of more than one round of ammunition when the dispenser gate is in the open position.

This particular embodiment of the disclosed technology further includes a safety lock device operably connected to the ejector plate 620. In this particular example, the safety lock is a pin 635 which is movable between a locked and an unlocked position. When the safety lock pin 635 is in the locked position, the ejector plate is prevented from actuation and locked in the closed position, thereby preventing accidental dispensing of ammunition. When the safety lock pin 635 is moved to the unlocked position the ejector plate is allowed to actuate between the open and closed position and thereby move the dispenser gate between the open and closed position so as to dispense ammunition. In other embodiments, a safety lock device is operably connected to the dispenser gate. In still other embodiments, a safety lock device is not a pin but rather a screw, bolt, level, latch, slide, or other device capable of securing the ejector plate and/or dispenser gate in the closed position.

It will be appreciated that several of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

While the claimed technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the claimed technology are desired to be protected.

What is claimed:

1. A device for storing and dispensing shotgun shells, comprising:

a generally rectangular housing sized and configured to receive shotgun shells, said housing having a front wall, a back wall, two side walls, a top wall, and an open bottom;

a follower device disposed within said housing;

a spring disposed between said follower device and said top wall and configured so as to urge said follower away from said top wall;

a dispenser gate movable between an open position and a closed position and configured to selectively block the open bottom of said housing in said closed position; and an ejector lever operationally connected to said dispenser gate and configured to selectively change said dispenser gate from the closed position to the open position;

wherein shotgun shells disposed within said housing are urged away from said top wall by said follower;

wherein shotgun shells are prevented from exiting said housing when said dispenser gate is in the closed position;

wherein a single shotgun shell is ejected from said open bottom when said dispenser gate is in the open position.

2. The device of claim 1, further comprising a dispenser gate spring operationally connected to said dispenser gate and configured to bias said dispenser gate in the closed position.

3. The device of claim 1, wherein said ejector lever is configured and arranged so as to be operated by a user's hand.

4. The device of claim 1, wherein said ejector lever is configured and arranged so as to be operated by a user's arm.

5. The device of claim 1, wherein said device further comprises an attachment selected from the group consisting of at least one strap, at least one clip, at least one mounting bracket, and combinations thereof.

6. The device of claim 1, wherein said device further comprises a movable blocking pin which prevents more than one shell from being ejected from said housing when said dispenser gate is in the open position.

7. The device of claim 1, wherein said device further comprises a basket portion configured and arranged so as to catch shells ejected from said open bottom.

8. The device of claim 1, wherein said device further comprises a safety lock pin operably connected to said ejector lever and configured so as to selectively prevent movement of the ejector lever from the closed position to the open position.

9. An ammunition dispensing assembly, comprising:

a generally rectangular housing sized and configured to receive ammunition, said housing having a front wall, a back wall, two side walls, a top wall, and an open bottom;

a follower device disposed within said housing;

a spring disposed between said follower device and said top wall and configured so as to urge said follower away from said top wall;

a dispenser gate movable between an open position and a closed position and configured to selectively block the open bottom of said housing in said closed position;

a dispenser gate spring operationally connected to said dispenser gate and configured to bias said dispenser gate in the closed position;

a movable blocking pin operationally connected to said dispenser gate and configured to prevent more than one round of ammunition from being ejected from said housing when said dispenser gate is in the open position; and an ejector lever operationally connected to said dispenser gate and configured to selectively move said dispenser gate from the closed position to the open position;

wherein ammunition disposed within said housing is urged away from said top wall by said follower;

wherein ammunition is prevented from exiting said housing when said dispenser gate is in the closed position;

wherein a single round of ammunition is ejected from said open bottom when said dispenser gate is in the open position.

10. The device of claim 9, wherein said ejector lever is configured and arranged so as to be operated by a user's hand.

11. The device of claim 9, wherein said ejector lever is configured and arranged so as to be operated by a user's arm.

12. The device of claim 9, wherein said device further comprises an attachment selected from the group consisting of at least one strap, at least one clip, at least one mounting bracket, and combinations thereof.

13. The device of claim 9, wherein said device further comprises a basket portion configured and arranged so as to catch ammunition ejected from said open bottom.

14. The device of claim 9, wherein said housing is sized and configured to receive shotgun shells selected from the group consisting of 10 gauge, 12 gauge, 20 gauge, and 410 gauge.

15. The device of claim 9, wherein said housing is sized and configured to receive low velocity grenade shells.

16. An ammunition carrying and dispensing device, comprising:

a generally rectangular housing sized and configured to receive ammunition, said housing having a front wall, a back wall, two side walls, a top wall, and an open bottom;

a follower device disposed within said housing;

a spring disposed between said follower device and said top wall and configured so as to urge said follower away from said top wall;

a dispenser gate movable between an open position and a closed position and configured to block the open bottom of said housing in said closed position;

an ejector lever operationally connected to said dispenser gate and configured to selectively move said dispenser gate between the closed position and the open position;

a spring operationally connected to said ejector lever and configured to bias said ejector lever to the closed position; and a blocking pin operationally connected to said ejector lever and configured to prevent more than one round of ammunition from being ejected from said housing when said ejector lever is moved to the open position;

wherein ammunition disposed within said housing is urged away from said top wall by said follower;

wherein ammunition is prevented from exiting said housing when said dispenser gate is in the closed position;

wherein a single round of ammunition is ejected from said open bottom when said dispenser gate is in the open position.

17. The device of claim 16, wherein said device further comprises an attachment selected from the group consisting of at least one strap, at least one clip, at least one mounting bracket, and combinations thereof.

18. The device of claim 16, wherein said device further comprises a basket portion configured and arranged so as to catch ammunition ejected from said open bottom.

19. The device of claim 16, wherein said housing is sized and configured to receive shotgun shells selected from the group consisting of 10 gauge, 12 gauge, 20 gauge, and 410 gauge.

20. The device of claim 16, wherein said housing is sized and configured to receive low velocity grenade shells.

* * * * *